United States Patent [19]

Jimenez et al.

[11] Patent Number: 4,771,714

[45] Date of Patent: Sep. 20, 1988

[54] ELECTRIC SEWING MACHINE WITH COMPUTERIZED CONTROL

[75] Inventors: Antonio Jimenez, Meyrin; Olindo Baruffa, Thonex; Claude Buchilly, Roche, all of Switzerland

[73] Assignee: Mefina S.A., Friborg, Switzerland

[21] Appl. No.: 49,106

[22] PCT Filed: Jul. 29, 1986

[86] PCT No.: PCT/CH86/00110

§ 371 Date: Apr. 10, 1987

§ 102(e) Date: Apr. 10, 1987

[87] PCT Pub. No.: WO87/01146

PCT Pub. Date: Feb. 26, 1987

[30] Foreign Application Priority Data

Aug. 16, 1985 [CH] Switzerland ..... 3541/85

[51] Int. Cl.[4] ..... D05B 59/00; D05B 69/18

[52] U.S. Cl. ..... 112/279; 112/220

[58] Field of Search ..... 112/279, 220, 277, 275; 242/20, 22, 23; 318/305

[56] References Cited

U.S. PATENT DOCUMENTS 2,255,152 9/1941 Colegrove ..... 112/220 X
4,161,153 7/1979 Nawa et al. ..... 112/220 X
4,527,496 7/1985 Kemmel ..... 112/279
4,667,612 5/1987 Hyodo et al. ..... 112/279 X

FOREIGN PATENT DOCUMENTS 3501638 8/1985 Fed. Rep. of Germany .
2187185 1/1974 France .
0614553 2/1986 Japan ..... 112/279
61-37195 2/1986 Japan ..... 112/279

*Primary Examiner*—Peter Nerbun
*Attorney, Agent, or Firm*—Cushman, Darby & Cushman

[57] ABSTRACT

An electric sewing machine with computerized control in which the speed of rotation of the central control motor (M) is brought under the control of a regulating circuit (O, $C_1$, $C_s$) comprising a control tacho generator (G), has a mechanism for driving a support for a bobbin (C) to be wound, comprising all the structural elements of the generator (G), a double action clutch ($E_A$) allowing the rotor of the generator (G) to be connected mechanically either to said central motor (M) or to the bobbin support, electrical switching means ($I_E$, $I_G$) allowing, in the last case, the armature of the generator (G) to be connected to an electrical supply source (A) while preventing the central control motor (M) of the machine from being supplied with current.

13 Claims, 7 Drawing Sheets

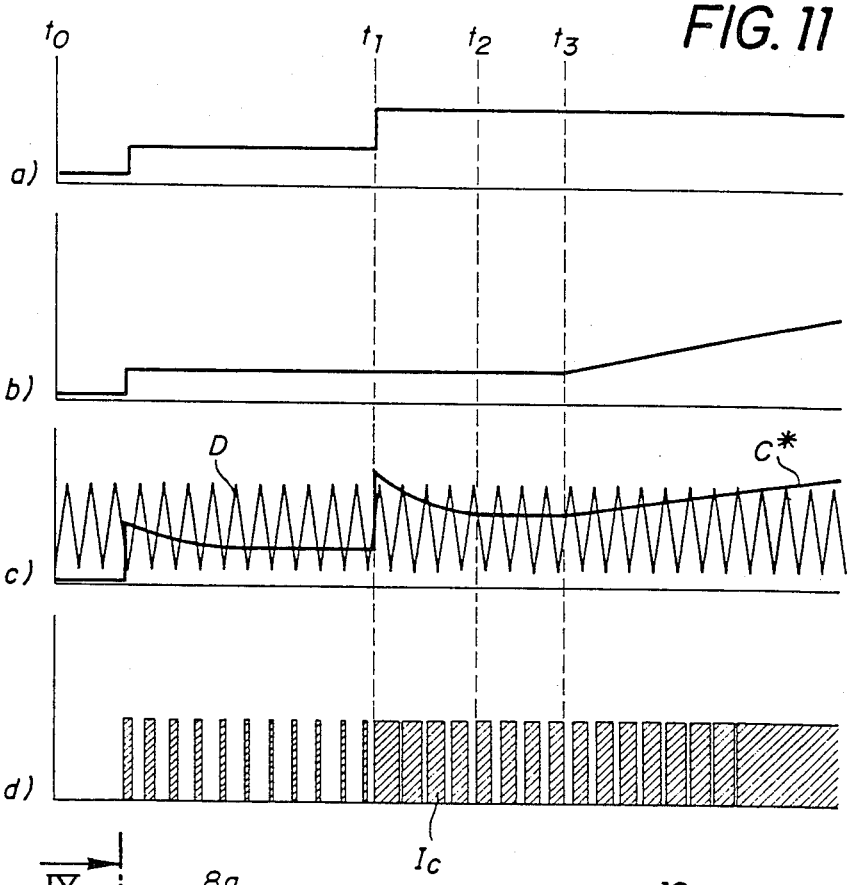
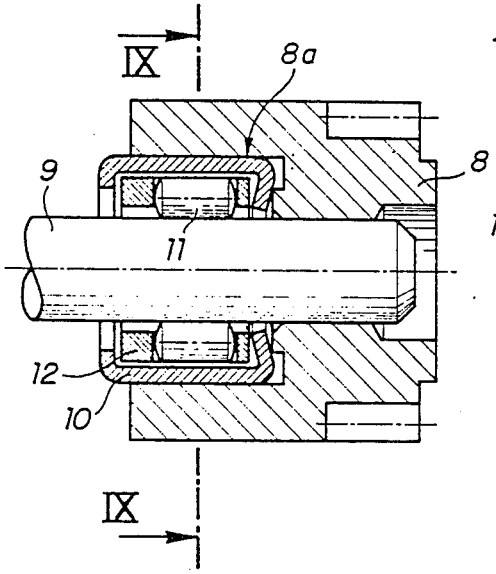
FIG. 8
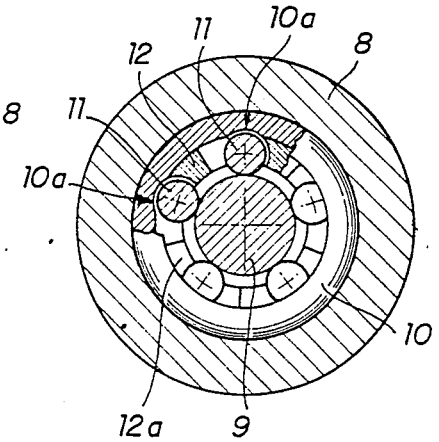
FIG. 9

ELECTRIC SEWING MACHINE WITH COMPUTERIZED CONTROL

BACKGROUND OF THE INVENTION

The present invention relates to an electric sewing machine with computerized control and more particularly to a machine in which the speed of rotation of at least some moving parts is dependent on the action of an electronic regulator of which the detecting circuit comprises at least one tacho-generator which is kinematically integral with said moving parts and is intended to emit a voltage which is representative of their instantaneous speed of rotation, and at least one source of reference voltage of which the value varies with the position occupied at each moment by a machine actuator, this regulator acting on the speed of rotation of the moving parts by permanent comparison between said voltages.

Numerous sewing machines of this type generally belonging to two distinct categories are already known, that is to say those in which said moving parts are capable of being attached mechanically by the regulator either to a driving motor rotating at a substantially constant speed or to a braking device, depending on whether the signal emitted by the generator moves away from the reference voltage value in one direction or the other, and those in which the moving parts in question are always kinematically integral with a driving motor of the machine, the regulator acting on the current supply of the motor in order to vary the speed of rotation thereof conversely to the deviations observed by the generator relative to the set value fixed by the position occupied by the machine actuator.

The state of the art affected by the first of these two categories of electric sewing machine includes, in particular, Swiss Patent No. 635.382 and U.S. Pat. No. 4,377,778 as well as European Patent Applications published under Nos. 67072, 67649 and 104913.

The second category of electric sewing machines mentioned above is illustrated, for example, in Soviet Patent No. 529.273 and, more recently, by Japanese Kokai No. 57-25187.

As in the case of purely mechanical or electromechanical machines, the known electric sewing machines with computerized control all comprise as indispensible accessory a device permitting the user to wind thread onto an empty bobbin, which has on the one hand a rotating support on which the bobbin is detachably fixed and, on the other hand, a driving mechanism for setting this support to rotation.

Such a device can assume different forms and, in particular, like the type shown, for example, in U.S. Pat. Nos. 3,587,494, 4,091,755 or 4,161,153 as well as French Patent No. 2078167, it can comprise a complete clutch system enabling the user instantaneously and kinematically to connect the bobbin support to the electric motor driving the entire machine either directly or via an intermediate moving part driven by it.

The use of an auxiliary low power motor having the sole object of driving the bobbin support directly, which the user can put into service or out of service as desired, has also been proposed (U.S. Pat. Nos. 2,255,152 and 3,741,492, published German Application No. 3501638 A1 and French Patent No. 72.21739).

The disadvantages of either of these two solutions are well known to a person skilled in the art. In fact, although the adoption of a computerized control means should, in principle, enable the number and architecture of parts driven by the machine motor to be substantially reduced, the range of the movements for throwing of the needle and for conveyance of the fabric being imposed "in situ" by individual step-by-step motors driven by the computerized control of the machine, and thus to lead to a structural simplification and, as a corollary, to a reduction in the risks of mechanical breakdown and the production and maintenance costs which should also be translated, in principle, by a reduction in the size of the machine casing and therefore also in its weight, the forced adoption of one or other type of winding device and its inclusion as a "foreign body" among the structural elements used exclusively for the "sewing" operation reduce the impact expected from the adoption of a technical solution which is as sophisticated as that adopted in a sewing machine with computerized control, that is to say in which its different functions are driven by a microprocessor from coded instructions stored in a solid state type read-only memory, in particular a ROM or a PROM.

SUMMARY OF THE INVENTION

The present invention, which relates specifically to an electric sewing machine with computerized control, of the type defined above and comprising, as known machines, a bobbin winding device comprising, as described, a bobbin support and a driving mechanism for setting such a support into rotation, aims to overcome the foregoing disadvantages and, to this end, proposes that this mechanism comprise (a) all the members constituting the tacho generator, (b) a double action clutch enabling the generator rotor to be coupled mechanically either to the rotating moving parts of the machine in a first operating position or to the bobbin support in a second position of the clutch, (c) change-over means connected to this clutch allowing the generator armature to be connected to a supply voltage source in order to allow electromagnetic driving of the rotor when the clutch occupies its second operating position and to interrupt this connection in the first operating position of the clutch, (d) and finally means for interrupting the drive of said moving parts during winding of the bobbin.

In a particular embodiment of the present invention, the change-over means are arranged so as to allow the generator armature to be connected either to the electronic regulator detection circuit in the first operating position of the clutch or to said supply source in the second operating position thereof.

The invention can therefore be used in a particularly worthwhile manner in electric sewing machines from the first of the two categories of machines mentioned above as well as from the second category.

In the latter case, that is to say in the case of an electric sewing machine with computerized control in which said rotating moving parts are permanently mechanically connected to a central motor for driving the machine, the electronic regulator thus acting directly on the speed of rotation of this motor, this sewing machine is advantageously and additionally characterized by the fact that the means for interrupting the driving of the moving parts comprise a switching circuit which acts on the current supply of the motor, this circuit being connected to the clutch so as to prevent this supply when this clutch occupies its second operating position.

BRIEF DESCRIPTION OF THE DRAWINGS

Further interesting characteristics and features of the electric sewing machine with computerized control according to the present invention will now be described with reference to the accompanying drawings given by way of example, in which:

FIG. 8 is a meridian section along VIII—VIII in FIG. 5.

FIG. 9 is a transverse section along IX—IX in FIG. 8.

FIG. 11 shows four graphs explaining the operation of the electronic regulator with which the machine is equipped.

DETAILED DESCRIPTION OF THE PRESENTLY PREFERRED EMBODIMENT

Figure 1:
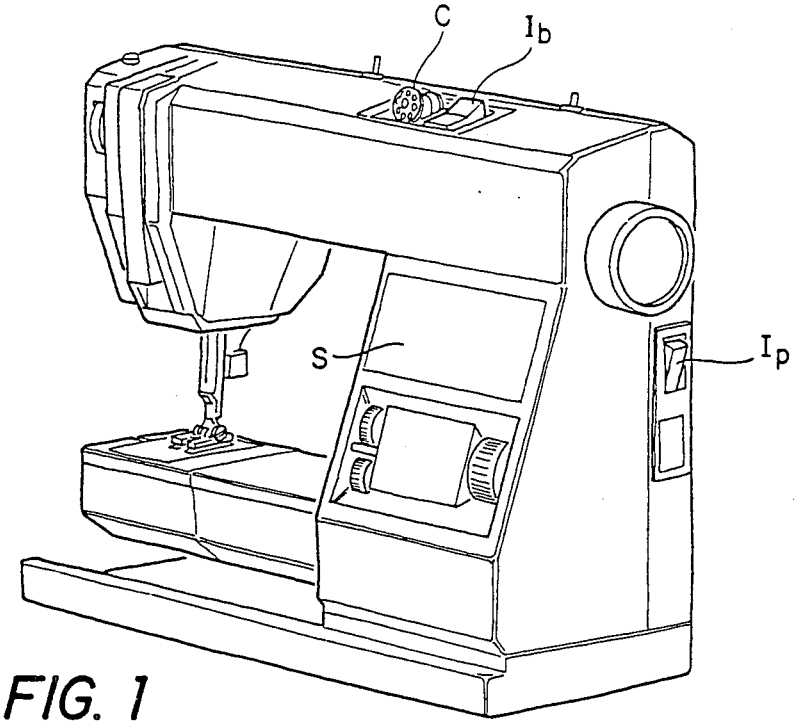
FIG. 1 is a three-quarter elevation of the sewing machine according to the invention.
Figure 2:
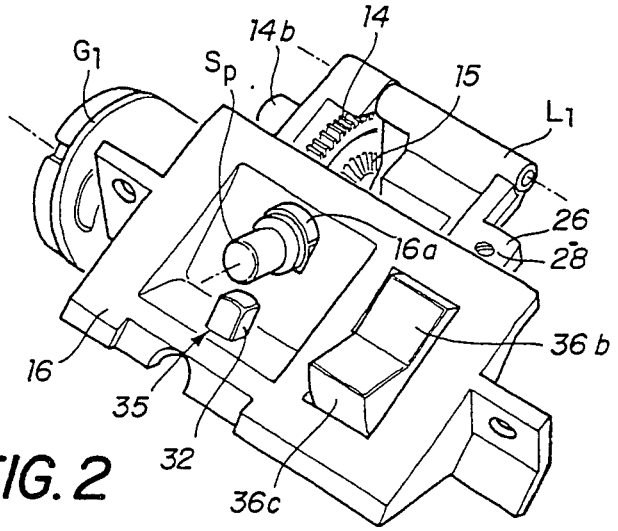
FIG. 2 is a detailed view of the machine in an inclined perspective on a very large scale showing the bobbin support and some of the double action clutch elements with which the driving mechanism for driving this support is provided.

The sewing machine shown in FIG. 1 is an electric machine with computerized control, that is to say a machine in which the essential functions are controlled and directed electronically by a microprocessor from circumstantial instructions previously stored in one or more memories, preferably solid state random access memories. These instructions can include, for example, the choice of speeds of sewing as a function of the nature and/or thickness of the parts to be sewn, of the type of stitch to be made, etc. In this outline illustration of the machine, the two switches $I_p$ and $I_b$ serving respectively for energizing the machine after connection to the supply circuit by an electric lead (not shown) and for putting into operation and out of operation an electric device enabling the user to wind a bobbin C with thread taken from a reel (also not shown), can essentially be seen.

Figure 10:
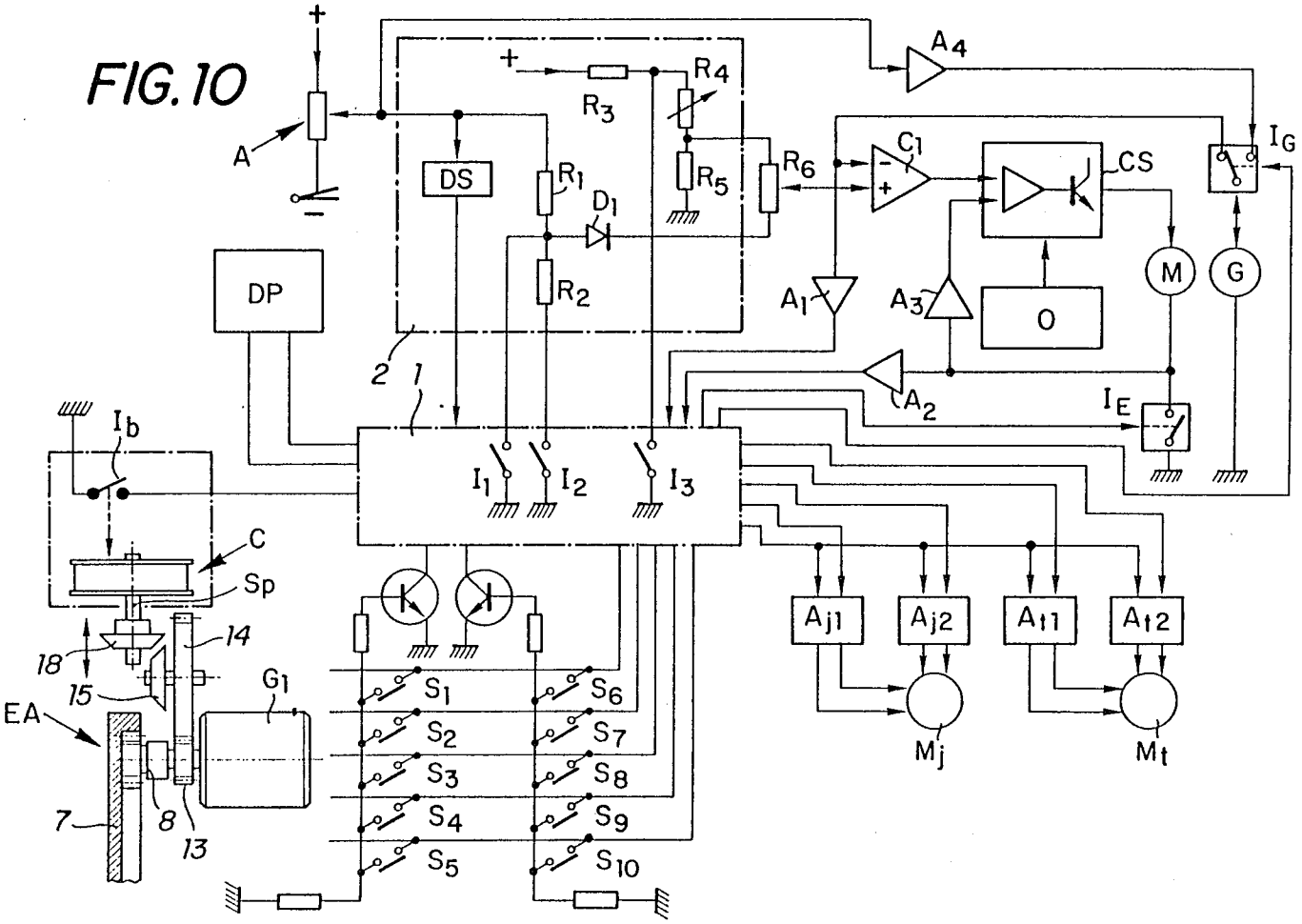
FIG. 10 shows the lay-out of the control circuit of the electric sewing machine according to a first embodiment of the invention.

With regard to the actual functioning of this machine, reference is made to FIG. 10 which shows schematically the main structural elements of its control circuit according to a first embodiment.

In the drawing, the rectangle 1 symbolises a microprocessor and the memory connected to it, the rectangle 2 represents a control block of a central motor M for driving the machine to which there may be connected in the manner described hereinafter a tacho generator G which is also shown at $G_1$ in this same FIG. 10. This generator G-$G_1$ forms part, in particular, of a circuit for regulating the speed of rotation of the motor M, the essential characteristics of which circuit will now be described although such a circuit has been known to the skilled man for a long time (see in particular the leaflet D542, paragraph 3,231 and FIG. 44, pages 57 and 58, published in June 1976, in chapter 3 "Commande des moteurs a courant continu" of the portion "Machines electriques" from the collection known as "Techniques de l'Ingenieur" produced under the management of Mr. Andrew Belot, see also pages 3-22 and 3-23 (FIGS. 3.3.15 to 3.3.17) of the August 1980 Edition (complete reprint of previous editions published in October 1972, October 1978, October 1975 and July 1978) of the publication "DC Motors Speed Controls Servo Systems" by the company called "Electro-Craft Corporation" of Hopkins, Minn. 55343 (U.S.A.); see finally the explanations given on page 53, entitled "Switchmode Regulator Control Circuits" in the publication 1984-F105 of Motorola Inc. named "the Switchmode Guide—linear and power products").

As known, such a regulating circuit comprises, in addition to the tacho generator G-$G_1$ already mentioned, an oscillator O constituting a time base emitting a saw-tooth periodic signal D (FIG. 11*c*) towards a control circuit CS also receiving a signal C* emanating from a first error amplifier $C_1$ which receives two signals, one which is shown as being of negative polarity in the drawing originating from the generator G and which is therefore characteristic of the effective speed of rotation of the motor M and the other of polarity represented as positive corresponding to a set value for the speed desired of this same motor M.

The graph a in FIG. 11 shows the development over time which the signal corresponding to the set value of the desired speed may have by way of example.

The graph b in this same figure shows a specific case of the development over time of the braking torque applied to the machine.

The graph c is characteristic (signal C*) of the mean power transmitted to the motor M.

The graph d in FIG. 11 shows the result of the action of the control circuit CS on the motor M supply current. It can be seen, in particular, that this motor is supplied by a sequence of pulses of current $I_c$ of the same amplitude but of which the duration corresponds to the time interval during which the amplitude of the signal C* (graph c) is greater than the amplitude of the pulse signal D. Thus, if the speed of the motor M is much lower than the set speed (portion of the curve C* comprised between moments $t_1$ and $t_2$), the duration of the pulses will be proportionally great so that in a short time the motor will receive the energy required to increase the speed thereof to the desired level. If, on the other hand, the speed of the motor M is closer than before to the set speed (portion of the curve C* comprised between moments $t_2$ and $t_3$), the pulses $I_c$ will in contrast be of shorter duration. This duration can increase without significant variation of the speed of the motor if the motor is required to provide a greater torque (see for example the extreme right-hand portion of the graph d in FIG. 11), for example if the machine has to sew a stack of fabric of increasing thickness at movement $t_3$. The above-mentioned publications give exhaustive details on the more particularly theoretical aspect of operation of the regulating circuit described. They are mentioned by way of reference in the present application.

As with earlier electric sewing machines, the value of the set signal, of positive polarity, directed toward the fault amplifier $C_1$ is characteristic of the instantaneous position occupied by an actuator of the machine, for example a pedal which the user can press in a more or less intense manner depending on the speed of rotation desired of the central motor M. In the drawing (FIG. 10) this actuator is represented by an ohmic voltage divider A attached via its output to a threshold detector DS included in the control block 2 and intended to emit a signal to the microprocessor 1 informing it that the user is actuating the pedal. This microprocessor then puts the switches $I_1$, $I_2$ and $I_3$ in the open position (these switches are in fact output transistors of the microprocessor) so that the circuit of current circulating in the control block 2 is looped through the resistors $R_1$, $R_6$ and $R_5$. At the output of the variable resistor $R_6$ there is obtained a signal of maximum amplitude directed towards the error amplifier $C_1$, this signal corresponding to the desired maximum speed of the motor M. By suitable choice of the value of the resistors $R_4$ and $R_6$, this speed could be, for example, of the order of 1,000 rpm By selecting resistors $R_1$ and $R_2$ of suitable value, it will be possible to limit the imposed value of the speed of rotation of the motor M, for example, to 800 rpm if the microprocessor 1 controls the closure of the switch $I_2$, in particular after receiving a corresponding instruction read in the memory. This may be the case, for example, when causing the machine to make a particular type of stitch.

When the user releases the actuating pedal, the threshold detector DS informs the microprocessor thereof, which then controls closure of the switch $I_1$ thus determining blockage of the diode $D_1$ so that the amplitude of the output signal of the resistor $R_6$ will be fixed exclusively by the value of the resistors $R_3$, $R_4$ and $R_5$. In this case, the motor of the sewing machine will turn at a minimum speed, for example of the order of 100 rpm.

In the present sewing machine, as in all known electric machines, the current supply of the central motor M is not interrupted once the actuating pedal has been released, that is when the motor is caused to turn at its minimum speed (100 rpm for example) except when the needle of the machine is completely freed from the fabric which it is causing to be sewn or decorated. For this purpose, the machine has a needle position detector which is shown schematically by the rectangle DP, the structural characteristics of the detector being well known to a skilled person and therefore not being repeated here in detail. Suffice it to say that use could advantageously be made of a structure comprising one or more disc-shaped masks having cut out radial slots and being set into rotation by the shaft controlling the axial movement of the needle periodically intercepting a ray of light perceived by a photoelectric cell when this ray is capable simultaneously of traversing a slot belonging to each disc and of which the angular position will be characteristic of the fact that the needle then occupies the desired high position.

In such a case, the signal received by the microprocessor of the photoelectric cell with which the detector DP is equipped determines the closure of the switch $I_3$ so that, when the two opposite ends of the resistors $R_4$ and $R_5$ are grounded, the output signal of the resistor $R_6$ is zero and the motor M is no longer supplied.

To prevent the motor M from continuing to turn even though the actuating pedal has been released, in particular as the result of an operating fault by one or other member of the control block 2 or of one or other switch $I_1$ to $I_3$, this motor is supplied with current through an electronic switch $I_E$ controlled by the microprocessor 1 among other things from the signal received from the generator G through an amplifier $A_1$.

A second amplifier $A_2$, connected between the motor M and the switch $I_E$, on the one hand, and the microprocessor 1 on the other hand, warns the microprocessor 1 that the motor M is absorbing an excessive current, for example as the result of an abnormally strong resistive stress imposed on the motor. In this case, the microprocessor will control the opening of the electronic switch $I_E$.

A third amplifier $A_3$ connected between the motor M and the switch $I_E$ on the one hand and the circuit CS controlling the supply of this motor, on the other hand, ensures that this circuit limits the value of the current traversing the motor to a maximum threshold value.

As again seen in the drawing (FIG. 10), the user can access different portions of the program stored in the memory connected to the microprocessor at will by actuation of one or other of the ten keys $S_1$ to $S_{10}$ of a keyboard which is not shown in detail in FIG. 1 but which may be positioned in the position marked by the rectangle S for example.

The sewing machine according to the invention is, moreover, equipped with two step-by-step motors, $M_j$ and $M_t$ designed to control the throw of the needle for the motor $M_j$ and to control the advance of fabric to be sewn with regard to the motor $M_t$. The rectangles $A_{j1}$ and $A_{j2}$, or $A_{t1}$ and $A_{t2}$ respectively represent the driver circuits supplying to the motor $M_j$ or $M_t$ respectively the pulses required for causing their armature to shift angularly by the desired amount and in the desired direction, these circuits being controlled by the microprocessor 1 as a function of the instructions received both from the memory and from the position detector DP (synchronization of the movements of the needle and of the fabric).

As shown with reference to FIG. 1, the sewing machine according to the invention also comprises, as known machines with purely mechanical, electromechanical or electronic operation with or without computerized control, a device enabling the user to wind a bobbin C as soon as he actuates the rocker switch $I_b$.

According to an essential feature of the present invention, this bobbin is set into rotation, in order to be wound, by means of the tacho generator G-$G_1$ in the manner now to be described.

For this purpose, the machine according to the invention is equipped, in particular, with a double action clutch enabling the axle of the generator to be connected mechanically either to the motor M if this generator is to transmit to the regulating circuit a signal which is characteristic of the instantaneous speed of rotation of this motor or to a support Sp intended to receive the bobbin to be wound, the armature of the generator being connected in that case to a supply voltage source so that this generator thus becomes a motor for driving the bobbin. In the last case, the supply of current to the motor M is prevented, for example, by opening the switch $I_E$.

As shown in FIG. 10, it is in fact possible to supply the armature of the generator G with the voltage appearing at the output of the ohmic voltage divider A, that is with a variable voltage of which the amplitude will be dependent on the position of the actuator and in this case the same pedal serving for actuation of the machine, this signal being amplified at $A_4$ and being directed towards the generator through an electronic switch $I_G$ controlled by the microprocessor 1 and capable of being placed in two active positions, one in which the generator can be connected to the actuator A as described, and the other for connection of this generator into the above-mentioned regulating circuit. Obviously the connection of the generator G to a source of supply voltage such as the actuator A, a source of low power, is only feasible if the rotor shaft of this generator, which operates at a driving speed, is not connected mechanically to the motor M. The double action clutch device $E_A$, shown schematically in the left-hand portion of FIG. 10 and of which the structural elements illustrated in detail in FIGS. 2 to 9 will now be described, permits just this.

Figure 3:
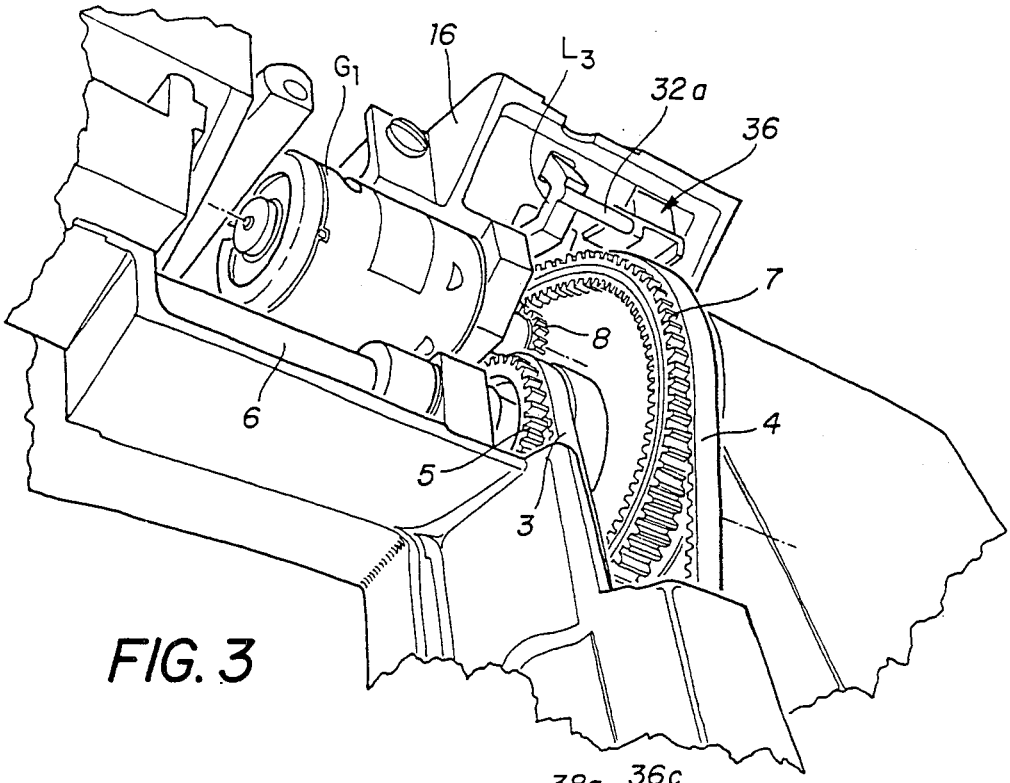
FIG. 3 is a view from below in perspective and cut away of the portion of the machine adjacent to the housing of the upper arm thereof with the vertical portion of the casing showing other members of this driving mechanism.

The generator $G_1$ is driven by the motor M by means of the assembly shown in FIG. 3 in which 3 and 4 are two synchronous belts driven directly by this motor which is not visible in the Figure but is situated in practice in the bottom part of the machine frame (FIG. 1). These belts mesh respectively with a pinion 5 integral with a shaft 6 on which the control of the reciprocating movement of the machine needle depends, and with a crown 7 which is externally and internally toothed. The belt 4 engages with the external teeth of the crown 7. With regard to its internal teeth, they serve for setting into rotation a pinion wheel 8 fixed on the rotor shaft 9 of the generator $G_1$ (FIGS. 8 and 9) by means of a unidirectional coupling comprising a casing 10 force-fitted into an axial housing 8*a* of the pinion 8 and intended for holding between the shaft 9 and the wall of this housing five needles 11 which assume a position in corresponding slots 12*a* traversing the wall of a sleeve 12 inserted in the casing 10 between the shaft 9 and longitudinal clearances 10*a* made in equidistant manner in the internal face of the casing 10. It can also be seen that the lateral faces of each slot 12*a* are rounded over a radius of curvature slightly greater than the cross sectional radius of each needle 11 in one case and flat in the other case. Furthermore, the profile of the rounded face of the slots 12*a* is continuous with the profile of the adjacent clearance 10*a* which is also rounded in the same manner.

Figure 5:
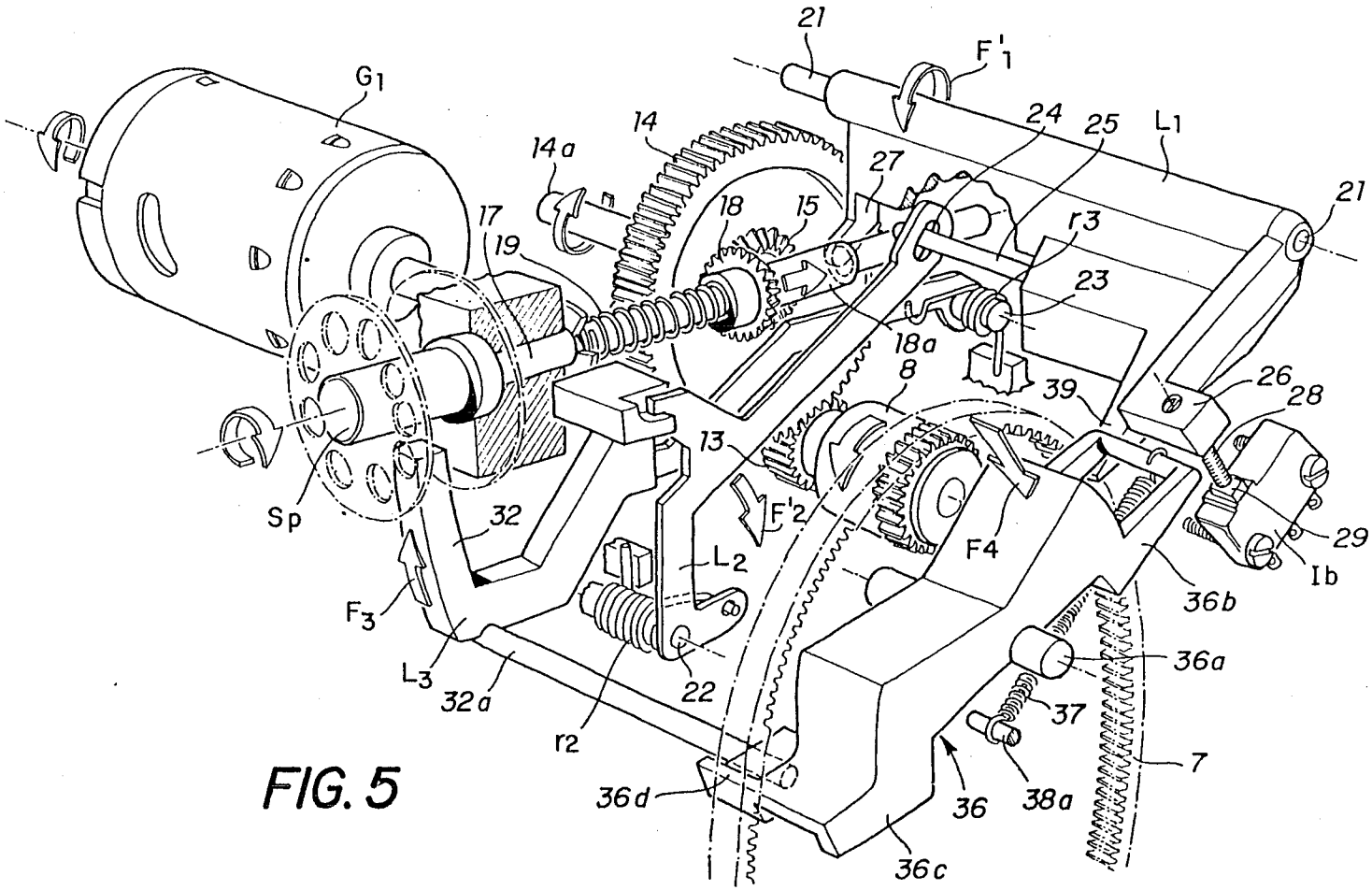
FIG. 5 is an exploded detail view showing the essential kinematisms of this driving mechanism.

Owing to the described arrangement it is possible to drive the shaft 9 by the pinion 8 provided that the pinion turns in an anticlockwise direction (FIG. 5). If the shaft 9 is set into rotation in an anticlockwise direction, the pinion 8 will not receive a driving torque and it will be possible to block it angularly without disturbing rotation of the shaft 9 of the generator (operating as a motor).

In the sewing machine illustrated, the unidirectional coupling just described is mounted on the shaft 9 of the generator so that this shaft is driven by the pinion 8 once the crown gear wheel 7 is driven in a clockwise direction while viewing FIG. 3. In this connection, the greatest difference between the diameters selected for the crown 7 and the pinion 8 will be noticed. In fact, to enable the generator to have the smallest possible dimensions and at the same time still to rotate at speeds corresponding to an operating range in which the voltage produced by the generator remains proportional to the angular velocity of the shaft of this generator, it is necessary for the value of this angular velocity to be relatively high even if the driving motor of the machine rotates at low speed, that is at approximately 100 rpm.

On the projecting portion between the pinion 8 and the generator $G_1$, the shaft 9 bears a second pinion 13 which is locked angularly on this shaft and engages with a toothed plate 14 (FIGS. 4, 5 and 10) to which abevel gear 15 having a diameter smaller than that of the plate 14 is fixed. The plate is provided with a spindle 14*a* mounted pivotally in a support 14*b* connected to a frame 16 (FIG. 2) to which the generator $G_1$ is also fixed (FIG. 3). As shown in FIG. 1, the upper portion of the frame 16 (FIG. 2) is flush with the surface of the upper arm of the sewing machine.

Figure 4:
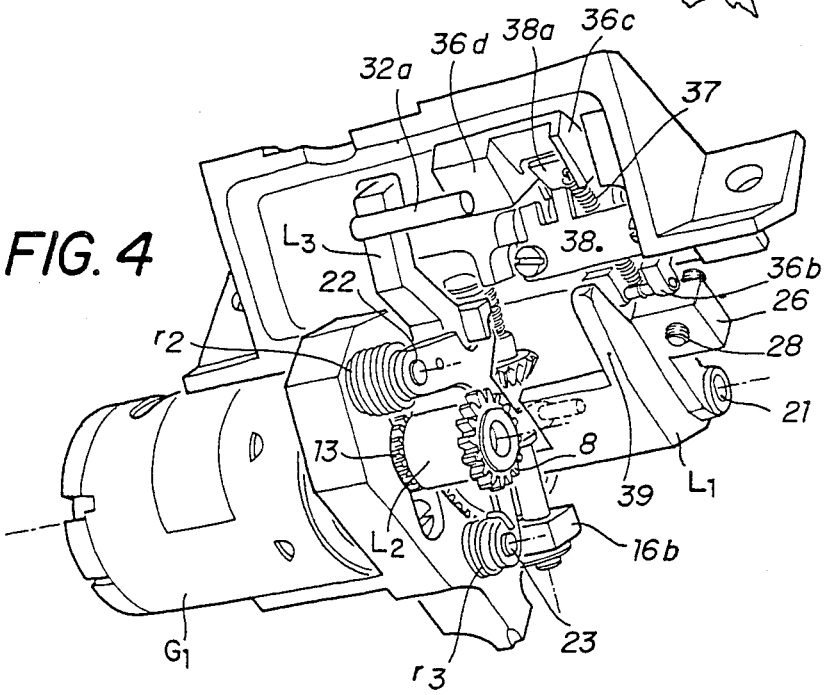
FIG. 4 is a perspective view from below of the mechanism for driving the bobbin support.
Figure 6:
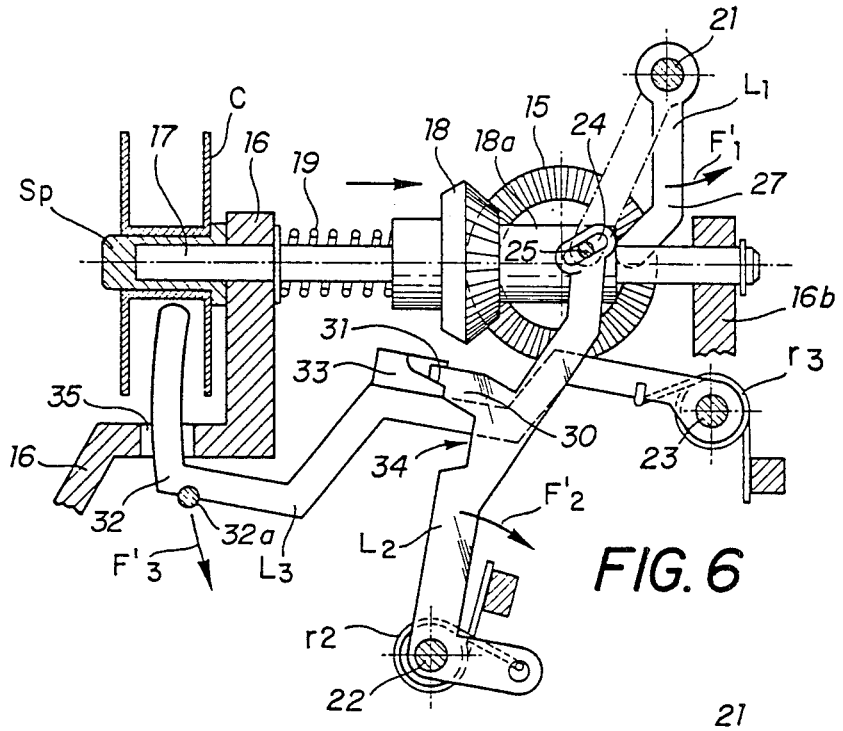
FIGS. 6 and 7 are schematic views in two distinct positions of certain elements illustrating the operation of the double action clutch with which the mechanism for driving the bobbin support is provided.
Figure 7:
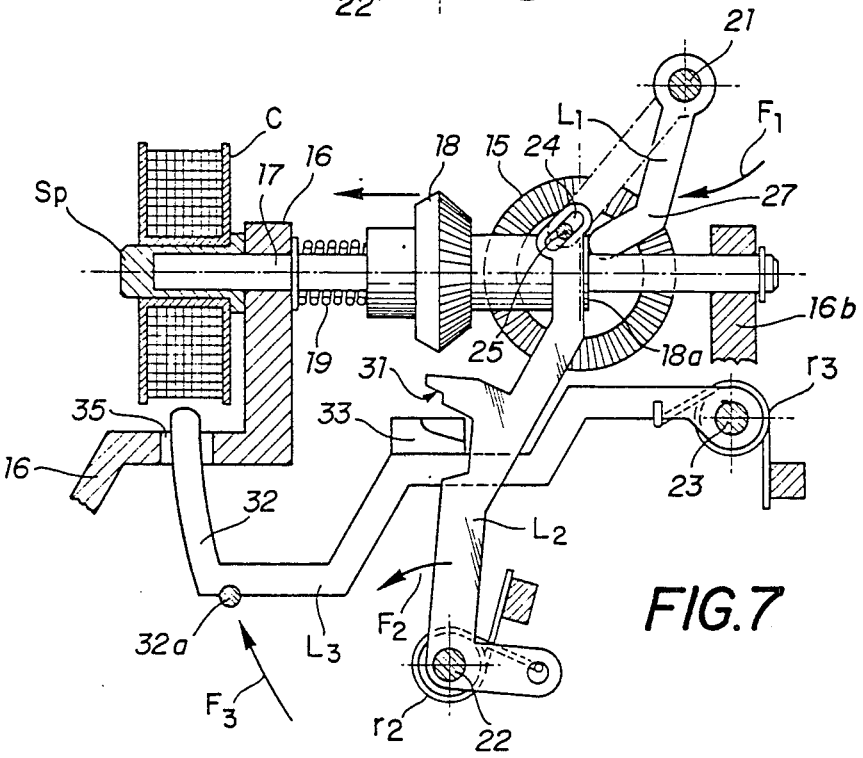

The bobbin support $S_p$ (FIGS. 2 and 5 to 7) already mentioned is integral with one end of a pin 17 traversing a boss 16*a* of the frame 16 (FIG. 2) perpendicularly to the spindle 14*a* of the plate 14 and pivoted at its other end in a lug 16*b* of this frame (FIGS. 4, 6 and 7). On its portion between the boss 16*a* and the lug 16*b*, the pin 17 bears, on the one hand, a bevel wheel 18 which is mounted on this pin so as to be able to slide longitudinally thereon while remaining angularly connected thereto and, on the other hand, a spring 19 stretched between the boss 16*a* and the pinion 18 and pushing the pinion 18 towards the lug 16*b* of the frame 16. The distance separating the pin 17 and plate 14 is such that, under the action of the spring 19, the pinion 18 meshes with the pinion 15 integral with this plate. As a result, while the pinion 18 remains engaged with the pinion 15, that is to say while nothing removes it from the pinion 18 by sliding on the pin 17 towards the spring 19, any rotation of the shaft 9 of the generator $G_1$ will cause corresponding rotation of the pin 17 and therefore of the bobbin support $S_p$.

For obvious reasons, it is however necessary for the bobbin support not to be set into rotation permanently by the shaft of the generator $G_1$, that is, in particular, when this generator is driven for its part by the central motor of the sewing machine during normal operation thereof. Furthermore, it is also obvious that this motor should remain stationary when the generator is to be used as a small motor for driving the support of the bobbin to be wound. Finally, it is necessary in the last case for the direction of rotation of the generator rotor to be such that unidirectional coupling described with reference, in particular, to FIGS. 8 and 9 prevents the pinion 8 from being set into rotation by the shaft 9 of the generator. In this case, the generator is to be supplied with a voltage of suitable polarity.

To enable the operations described above to be carried out, the invention proposes the use of a number of mechanical as well as electrical measures which will now be described with more particular reference to FIGS. 5 to 7 and 10.

The supply of the motor M is interrupted and the generator G is connected to the voltage source constituted by the ohmic divider of the actuator A by corresponding change-overs of the electronic switches $I_E$ and $I_G$ (FIG. 10) controlled by the microprocessor 1 as soon as the user actuates the switch $I_b$ of which the rocker push button is shown in FIG. 1.

At this point, it should be pointed out that, with the machine described, manual actuation of the switch $I_b$ in one direction or the other is not automatically translated into connection of the motor M or the armature of the generator G-$G_1$ to their respective source of energy supply. In fact, and according to an interesting feature of the present invention, the program of the machine is designed such that, during closure or opening of the switch $I_b$, the switches $I_E$ and $I_G$ are actuated only if the microprocessor receives from the threshold detector DS a signal indicating that the user has released the actuator A. Moreover, even in this case, the microprocessor will not command actuation of the switches immediately but only after a few seconds (timing subroutine of the program) so as to allow significant deceleration of the motor or of the generator, or even stoppage thereof for the safety of the user.

The driving of the bobbin support $S_p$ is interrupted, when the user intends to continue sewing, once the bobbin is filled, by guiding the bevel wheel 18 from the position in which it meshes with the pinion 15 (FIG. 6) into a second axial position (FIG. 7) in which the pinion 18 is remote from the pinion 15. This interruption can take place by suitable manual actuation of the push button of the switch $I_b$, or it can take place automatically once the bobbin is wound.

For this purpose, the sewing machine according to the invention is provided with a device of which the structural features will now be described.

This device substantially comprises three levers $L_1$, $L_2$ and $L_3$ which are articulated about pins 21, 22 and 23 respectively which are parallel to the shaft 9 of the generator and are fixed to the frame 16. The levers $L_2$ and $L_3$ are subjected to the action of springs $r_2$ and $r_3$, tending to cause the respective levers to rock in angular directions $F_2$ and $F_3$ (FIG. 7).

At its free end, the lever $L_2$ has an oblong eye 24 in which there is freely inserted a rod 25 projecting on the side of the lever $L_1$ parallel to its axis of rocking 21. Owing to this connection, it is possible for the lever $L_2$ to rock freely in direction $F_2$ under the influence of the spring $r_2$ while controlling rocking of the lever $L_1$ in direction $F_1$. Conversely, if the lever $L_1$ is rocked in direction $F'_1$ (FIG. 6) opposed to the preceding direction $F_1$, this lever will drive the lever $L_2$ into a rocking movement in direction $F'_2$ in opposition to the action of the spring $r_2$.

The maximum range of rocking by the lever $L_1$ in direction $F_1$ is fixed by the striking of a tab 26 on this lever (FIGS. 2, 4 and 5) against the frame 16. The rocking of this same lever in direction $F'_1$ in limited by cooperation with the levers $L_2$ and $L_3$. However, it is selected so as to be sufficient in either case to allow a thrust element 27 integral with the lever $L_1$ and in contact with the righthand end of a tubular extension 18*a* of the pinion 18 to remove this pinion from the driving pinion 15 during rocking in direction $F_1$ by lever $L_1$ and to bring it into the meshing position with the same pinion 15 at the end of a rocking movement in the opposite direction $F'_1$.

It should again be mentioned that, in addition to the foregoing function, the tab 26 also performs the function of a member for controlling the electric switch $I_b$ already mentioned with reference to the diagram in FIG. 10 and which is shown in perspective in FIG. 5. For this purpose, the tab 26 is provided with a push button constituted by a screw 28 capable of acting on a switch control stud 29. This will preferably be fixed on the frame 16 at a distance from the tab 26 which is smaller than the length of the projecting portion of the screw 28, and this distance can be adjusted precisely by more or less marked screwing of the push button 28.

As shown more particularly in FIGS. 6 and 7, the two levers $L_2$ and $L_3$ cross over halfway along their length. The lever $L_2$ comprises a nose piece 30 with a cutout 31 in the form of a corner opening towards the hinge pin 22 of this lever and towards the free end of the lever $L_3$ which is bent back at 32 respectively. This lever $L_3$ has a projection 33 extending perpendicularly to the Figure up to the lever $L_2$, of which the portion turned towards the cutout 31 of the nose piece 30 has a profile similar to that of this cutout. It should be noted at this point that the lever $L_2$ also has a notch 34 with inclined edges made in a position adjacent to the cutout 31.

The assembly constituted by the cutout 31 and the projection 33 thus forms a locking member with escapement enabling the lever $L_2$ and, by corollary, the lever $L_1$ to be held in the rocked position shown in FIG. 6 in which the pinion 18 engages with the driving pinion 15 in spite of the action of the spring $r_2$ acting on the lever $L_2$ (maintenance of the driving of the bobbin support by the generator).

However, if the lever $L_3$ is rocked in direction $F_3$ (FIG. 7), this locking ceases to exist once the projection 33 escapes from the contact of the cutout 31 and penetrates into the notch 34 in the lever $L_2$. In this case the spring $r_2$ will control the rocking of this lever in direction $F_2$, that of the lever $L_1$ in direction $F_1$ and therefore the distance between the bevel wheel 18 and the driving wheel 15 (interruption in the driving of the bobbin support by the motor generator).

The rocking of the lever $L_3$ in direction $F_3$ may be achieved in two different ways:

automatically, when the bobbin placed on the support $S_p$ is full, manually, if desired by the user.

As already described, the free end of the lever $L_3$ is curved back at 32. It is engaged in the opening of a window 35 made in the frame 16 opposite the bobbin support $S_p$. When the lever $L_3$ is in the position for locking the lever $L_2$ shown in FIG. 6, the bent back portion 32 of the lever $L_3$ extends freely into the space between the flanges and the hub of any bobbin fixed to the support $S_p$. As the bobbin fills, the external surface of the winding of thread approaches the portion 32 of the lever, comes into contact with it and pushes it back, causing it to rock in direction $F_3$. As a result, the projection 33 of the lever $L_3$ begins to clear the cutout 31 of the lever $L_2$ while sliding onto the portion thereof adjacent to the notch 34 until the moment when it frees the lever $L_2$ and engages in this notch (FIG. 7).

Manual control of rocking in direction $F_3$ of the lever $L_3$ and, by corollary, the unlocking of the lever $L_2$ can be effected by actuation of the rocker push button 36 for controlling the switch $I_b$ (FIGS. 1 and 5) which is articulated on the frame 16 by means of a pin 36*a* orientated in parallel with the rocking axis of each of the three levers $L_1$, $L_2$ and $L_3$. This push button is capable of being brought into two symmetrical positions in each of which it can be held stably by a draw spring 37 stretched between the bar 36*b* of the push button and the end 38*a* of a support 38 connected to the frame 16. It will be noted in this case that this support is such that its end 38*a* is located opposite the pin 36*a* of the push button relative to the end at which the spring 37 is fixed to the bar 36*b*. The bar 36*c* of the push button is provided with a support tab 36*d* in contact with a rod 32*a* projecting laterally over the lever $L_3$, particularly when this lever occupies the position illustrated in FIG. 6 for locking the lever $L_2$ (FIGS. 4 and 5). Under these conditions, the push button 36 occupies the position shown in FIG. 2, that is in which the bar 36c projects largely above the frame 16 whereas the bar 36b is substantially flush with the upper face of this frame. It is sufficient to exert a pressure on the bar 36c to enable it to drag in its travel the rod 32a of the lever $L_3$ thus determining the rocking thereof in direction $F_3$ (FIG. 7). As the lever $L_2$ in unlocked in this case, the action thus exerted on the bar 36c of the push button 36 thus leads to the separation of the pinion wheels 15 and 18 and, therefore, to stoppage of the bobbin C. Furthermore, since the lever $L_1$ has rocked in direction $F_1$, the push button 28 moves away from the switch $I_b$ which then assumes an open position causing the electronic switches $I_E$ and $I_G$ to rock into their second operating position in which the motor M can be supplied with current once the user acts on the switch A and the generator G is connected to the circuit for regulating the speed of the motor.

The push button with rocker 36 also enables the described mechanism to be "set", that is allows the levers $L_1$, $L_2$ and $L_3$ to be brought back into the position illustrated in FIG. 6 and allows the pinion wheel 18 for driving the bobbin to be brought into engagement with the pinion wheel 15. In fact, and as shown more particularly in FIGS. 4 and 5, the lever $L_1$ is provided with a nose piece 39 projecting beneath this lever on the side of the above-mentioned tab 26 and extending partially beneath the bar 36b of the push button 36 at a short distance from t, in particularly when this push button occupies the rocked position symmetrical to that illustrated in FIG. 2. It will therefore be sufficient to exert a thrust in direction $F_4$ (FIG. 5) on the bar 36b of the push button to drive the lever $L_1$ in direction $F'_1$ by action on the nose piece 39 of this lever. It will be noted that, while doing this, in addition to causing corresponding rocking in direction $F'_2$ of the lever $L_2$, a movement of the lever $L_3$ in direction $F'_3$ under the influence of its restoring spring $r_3$ will be produced, this movement ending, as described, when the projection 33 of the lever $L_3$ has come into contact with the edges of the cutout 31 of the lever $L_2$.

It will again be noticed that the rocking capacity in either direction of the push button 36 is limited when the free end of one or other bar 36b and 36c of the rocker strikes the edge of the opening of the frame 16 in which this push button is positioned.

Figure 12:
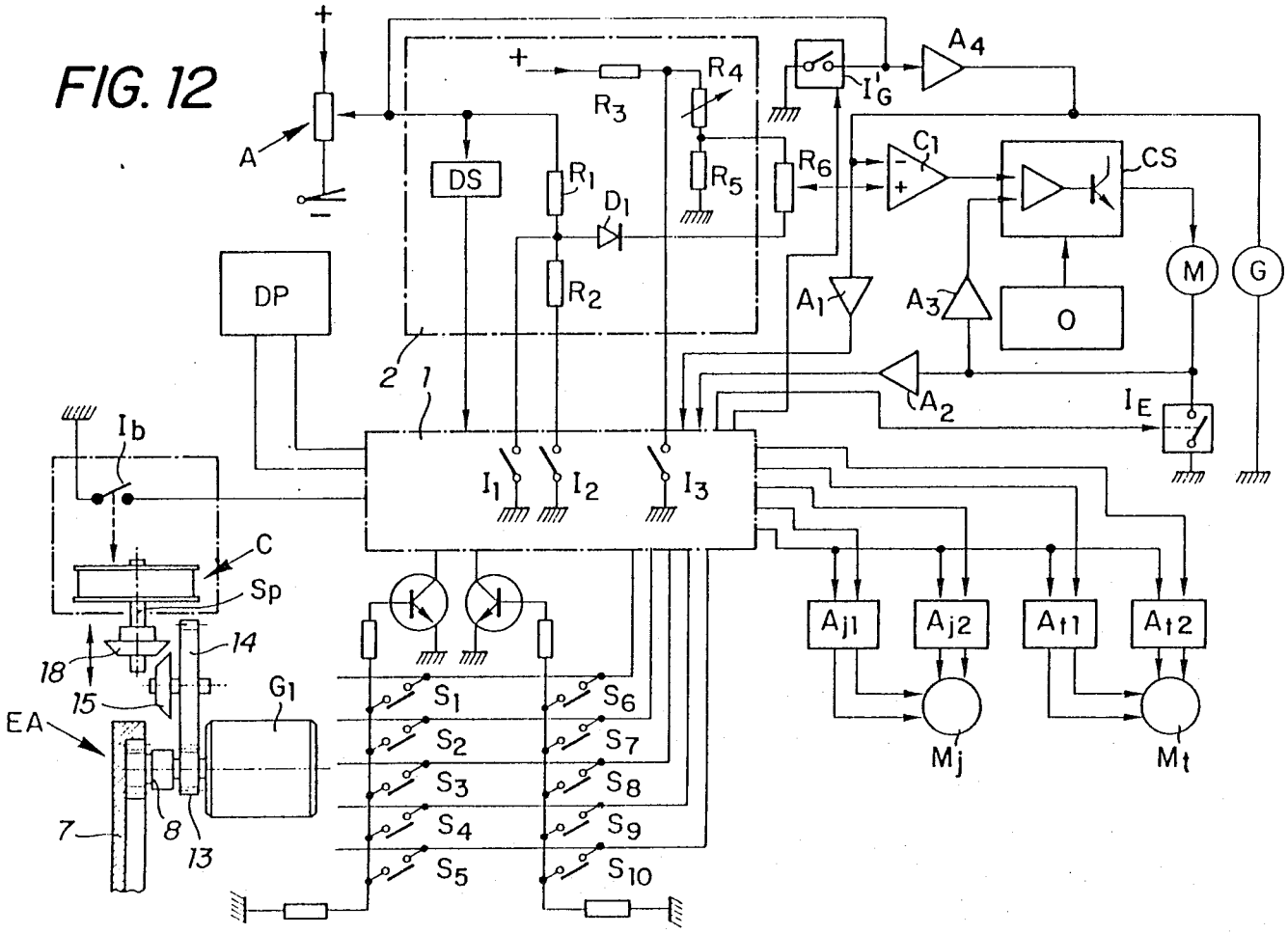
FIG. 12 shows a diagram similar to that in FIG. 10 according to a second embodiment of the invention.

The second embodiment (FIG. 12) of the sewing machine according to the invention only differs from the first (FIG. 10) by the manner in which the generator G can be electrically connected to the actuator A in the winding phase of a bobbin C.

Thus, in this embodiment, the armature of the generator remains permanently connected on the one hand, to the input, shown as positive, of the amplifier $C_1$ and, on the other hand, to the output of the amplifier $A_4$ which is itself connected to the actuator A, this amplifier being put into operation and out of operation by the control of an electronic switch $I'_G$ which is actuated by the microprocessor 1 during closure of the switch $I_b$ (in a manner similar to that adopted with the switch $I_G$ in the embodiment shown in FIG. 10).

In fact, the electronic switch $I'_G$ is also connected to ground so that, in the closed position, no signal is delivered by the amplifier $A_4$ whatever the position of the actuator A. On the other hand, a signal will be delivered by the amplifier $A_4$ if the switch $I'_G$ is open, providing, of course, that the actuator A is brought into a position other than the rest position.

In this case, actuation of the electronic switch $I'_G$ is synchronized with that of the electronic switch $I_E$ and is controlled, like the last mentioned one, by the microprocessor 1, on the basis of information received from the switch $I_b$.

Thus, if the switch $I_b$ is brought into the closure position, the microprocessor will control the switches $I_E$ and $I'_G$ in the opening direction. If, on the other hand, the switch $I_b$ is actuated for opening, the switches $I_E$ and $I'_G$ will be controlled in the direction of closure.

As can been seen, despite its high level technical performance, the double action clutch device just described is both compact and simple to produce. All of its parts, which can be produced, in particular, by injection molding of a suitable plastics material, are subjected only to low intensity mechanical stresses since the movements of these parts are controlled by the generator G which is capable of delivering only reduced power at the driving speed. Consequently, the fact that the clutch device described is assured of great longevity even when used intensively and repeatedly is added to the above-mentioned advantages.

It can also be observed that the installation of the invention described necessitates only slight adaptation of the conventional electronic circuit of an electric sewing machine with computerized control without substantial modification of the structural complexity inherent in such a circuit and, therefore, without substantial increase of its cost price.

Although the invention has been described with reference to a sewing machine with computerized control in which the operating speed is regulated by direct action on the control motor, it is obvious that all the principles set out can be used, mutatis mutandis, in a machine in which this regulation is not carried out on the actual motor but on certain moving parts situated downstream of this motor as, for example, in the case of the machines illustrated in Swiss Patent No. 635.382 and the U.S. Pat. No. 4,377,778 mentioned above.

We claim:

1. In an electric sewing machine having a computerized control in which the speed of rotation of at least some moving parts is dependent on the action of an electronic regulator having a speed measuring circuit including at least one tacho generator which is kinematically connected to said moving parts and emits a voltage representative of the instantaneous speed of rotation of said moving parts, and at least one source of reference voltage having a value which varies with the position occupies at any moment by an actuator of the machine, said electronic regulator acting on the speed of rotation of the moving parts by permanent comparison of said voltages and in which a device permits the user to wind thread on an empty bobbin, said device having a rotating support on which the bobbin may be detachably fixed and a driving mechanism for setting the support into rotation, said driving mechanism comprising:

(a) a stator and a rotor disposed in said generator;

(b) double action clutch means for mechanically coupling said rotor to said moving parts in a first operating position and to said rotating support in a second operating position of said clutch means;

(c) change-over means connected to said clutch means, for connecting said stator to a supply voltage source in order to allow electromagnetic driving of the rotor when said clutch means occupies its second operating position, and for interrupting the connection between said supply voltage source and said stator in said first operating position of the clutch means; and (d) means for interrupting the driving of said moving parts during winding of the bobbin.

2. A sewing machine according to claim 1, wherein said change-over means are arranged to cause said stator to be connected to the speed measuring circuit of said regulator in said first operating position of the clutch means, and to said supply voltage source in said second operating position of said clutch means.

3. A sewing machine according to claim 1 wherein said moving parts are permanently connected to a driving motor, said electronic regulator acting directly on the speed of rotation of said motor, and wherein said means for interrupting the driving of said moving parts comprise switching circuit means acting on a current supply of said motor, said switching circuit means being connected to said clutch means to prevent supply of said current to said motor when said clutch means occupies its second operating position.

4. A sewing machine according to claim 1 further comprising (a) electric motor means for driving said moving parts, (b) means for controlling an instantaneous position occupied by said actuator, and (c) means for preventing connecting said motor means and/or said stator to a source of supply while said actuator occupies a position other than a rest position.

5. A sewing machine according to claim 1 further comprising gear wheels for driving said generator from said moving parts, said gear wheels comprising (a) at least one crown wheel which is kinematically connected to said moving parts, and (b) at least one pinion wheel meshing with said crown and connected to said generator, and wherein said clutch means includes a unidirectional clutch for mounting said pinion wheel on a shaft of said generator, said unidirectional clutch comprising (a) second gear wheels which are kinematically connected to said shaft of said generator, (b) a second pinion wheel which is angularly connected to a pivoting pin bearing said bobbin support, said second pinion wheel being mounted so as to slide on said pivoting pin and being capable of being guided by elastic means and by sliding on said pivoting pin in engagement with a last moving part of said second gear wheels, (c) a bistable rocker comprising a push button capable of acting on said second pinion wheel in order to remove said second pinion wheel from said moving part of the second gear wheels by sliding on said pivoting pin and toward said elastic means when the rocker is guided from a first stable position in which a push button is remote from said second pinion wheel into a second stable position.

6. A sewing machine according to claim 5, further including a bobbin support shaft, and wherein said generator shaft and said bobbin support shaft are disposed in orthogonal planes, a last moving part of the second gear wheel and the second pinion wheel being bevel gears.

7. A sewing machine according to claim 6, wherein said bistable rocker comprises (a) a first lever of which an intermediate portion of its length forms said push button, said first lever being mounted so as to rock in a plane extending transversely to said generator shaft, (b) a second lever articulated at a distance from the first lever and mounted so as to rock in parallel with the rocking plane of the first lever, a free end of said second lever being connected to the first lever by a linking member allowing the first lever to rock about a first lever pivot pin and at the same time to slide in a longitudinal direction of said second lever, the respective movement of each lever thus being kinematically dependent on that of the other lever, said second lever being subjected to the action of an elastic means tending to lead the first lever into a limit angular position corresponding to said stable second position of the rocker, (c) means for detachably locking with escapement connected to said second lever and being capable of holding said second lever toward said elastic means in an angular position to cause said push button to remain remote from said second pinion wheel.

8. A sewing machine according to claim 7, wherein said detachable locking means comprise a third lever mounted pivotally about a pin situated between pivot pins of said first and second levers and articulated in a plane parallel to the respective rocking planes of said first and second levers, said third lever being subjected to the action of a third lever elastic means tending to cause said third lever to rock in an angular direction opposed to a rocking direction of said second lever, said third lever being oriented between said first and second levers so as to pass in the vicinity of a central portion of said second lever by its own median portion and in that, on said median portion, the second lever has a corner-shaped circuit opening towards the axis of articulation of said second lever and towards the free end of said third lever respectively, said third lever having, on a portion close to said cutout of the second lever, a projection having a shape similar to that of said cutout and being inserted in said cutout under the influence of the elastic means connected to the third lever and in a first limit angular position thereof when the second lever is led into its angular position corresponding to the second stable position of the rocker, said third lever thus permitting said rocker to be locked in a stable position.

9. A sewing machine according to claim 8, wherein said second lever has a notch in a position adjacent said cutout, said notch having edges which converge in a direction of a base of said notch, said notch being capable of receiving said projection of the third lever at least in a second limit angular position thereof corresponding to said first stable position of the rocker.

10. A sewing machine according to claim 9, further including means for controlling the rocking of the third lever between its first angular position and a second limit angular position thereof.

11. A sewing machine according to claim 10 wherein said moving parts are permanently connected to a driving motor, said electronic regulator acting directly on the speed of rotation of said motor, and wherein said means for interrupting comprise switching circuit means acting on a current supply of said motor, said switching circuit means being connected to said clutch means to prevent supply of said current to said motor when said clutch means occupies its second operating position, said switch circuit means comprising an electric switch and a rocking push button having two bars on which control of said electric switch depends, a rocking plane of said rocking push button being parallel to the rocking planes of said first, second and third levers, and wherein said rocking push button is arranged in such a way that, by rocking it in a first angular direction, one of its bars strikes a free end of the first of said levers, thus allowing this first lever to be pushed and to be removed from its limit angular position corresponding to said second stable position of the rocker and bringing said first lever into its other limit position corresponding to the first stable position of this rocker, rocking of said rocking push button in a second angular direction opposed to the previous one bringing another bar of said rocking push button to rest on a portion of the third lever, at least during a portion of this rocking, said third lever thus being removed from its first limit angular position, the locking of said second lever, and being guided into its second limit angular position in which the projection of the third lever is engaged in the notch in the second lever.

12. A sewing machine according to claim 11, wherein said rocking push button engages a switch control member by means of a thrusting element connected to the first lever.

13. A sewing machine according to claim 9, wherein a free end of said third lever forms a feeler and extends substantially in a plane of an axis of the bobbin support, said free end of the third lever being profiled in such a way that, when said third lever is in its limit angular position corresponding to the locking of the second lever, said free end extends at least in part into a space between lateral flanges of any empty bobbin fixed on the bobbin support, said feeler being pushed outside said space as the bobbin is wound by contact with a thickness of thread wound on the bobbin until it causes rocking of the third lever which is sufficient to unlock the second lever and to remove said second pinion wheel which is angularly connected to the pin of the bobbin support of the second gear wheel driven by the shaft of the generator.

* * * * *

UNITED STATES PATENT AND TRADEMARK OFFICE

CERTIFICATE OF CORRECTION

PATENT NO. : 4,771,714

DATED : September 20, 1988

INVENTOR(S) : JIMENEZ ET AL

It is certified that error appears in the above-identified patent and that said Letters Patent is hereby corrected as shown below:

Title page:

Assignee: Mefina S.A., Fribourg, Switzerland

Signed and Sealed this

Thirtieth Day of May, 1989

*Attest:*

DONALD J. QUIGG

*Attesting Officer*

*Commissioner of Patents and Trademarks*